US005876273A

United States Patent [19]

Yano et al.

[11] Patent Number: 5,876,273

[45] **Date of Patent: *Mar. 2, 1999**

[54] APPARATUS FOR POLISHING A WAFER

[75] Inventors: Hiroyuki Yano; Katsuya Okumura, both of Yokohama; Norio Kimura, Fujisawa; Tomoyuki Yahiro, Fujisawa; Hozumi Yasuda, Fujisawa, all of Japan

[73] Assignees: Kabushiki Kaisha Toshiba, Kawasaki; Ebara Corporation, Tokyo, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 625,291

[22] Filed: Apr. 1, 1996

[51] Int. Cl.[6] ..... B24B 29/02

[52] U.S. Cl. ..... 451/288; 451/290; 451/398; 451/41

[58] Field of Search ..... 451/41, 59, 286, 451/63, 287, 288, 289, 290, 397, 398, 402

[56] References Cited

U.S. PATENT DOCUMENTS

| | | | |
|---|---|---|---|
| 4,193,226 | 3/1980 | Gill, Jr. et al. | 451/289 X |
| 4,739,589 | 4/1988 | Brehm et al. . | |
| 4,920,700 | 5/1990 | Murahashi et al. | 451/289 X |
| 4,954,142 | 9/1990 | Carr et al. . | |
| 5,081,421 | 1/1992 | Miller et al. . | |
| 5,193,316 | 3/1993 | Olmstead . | |
| 5,205,082 | 4/1993 | Shendon et al. . | |
| 5,267,418 | 12/1993 | Currie et al. . | |
| 5,398,459 | 3/1995 | Okumura et al. | 451/286 X |
| 5,423,558 | 6/1995 | Koeth et al. . | |
| 5,423,716 | 6/1995 | Strasbaugh . | |
| 5,443,416 | 8/1995 | Volodarsky et al. . | |
| 5,449,316 | 9/1995 | Strasbaugh . | |
| 5,533,924 | 7/1996 | Stroupe et al. | 451/286 |
| 5,584,746 | 12/1996 | Tanaka et al. | 451/398 X |
| 5,584,751 | 12/1996 | Kobayashi et al. . | |

FOREIGN PATENT DOCUMENTS

| | | | |
|---|---|---|---|
| 0747167 A2 | 12/1996 | European Pat. Off. . | |
| 55-157473 | 12/1980 | Japan . | |
| 56-146667 | 11/1981 | Japan | 451/288 |
| 58-10193 | 2/1983 | Japan . | |
| 6-23659 | 2/1994 | Japan | 451/287 |

*Primary Examiner*—Timothy V. Eley
*Attorney, Agent, or Firm*—Banner & Witcoff, Ltd.

[57] ABSTRACT

A polishing apparatus is provided which improves uniformity across the surface of a polished wafer. The apparatus includes a wafer carrier, a guide ring coupled to a lower portion of the wafer carrier, a circular plate coupled to a first inner circumference portion of the guide ring distant from the wafer carrier, and a cavity, formed within an area bounded by the lower portion of the wafer carrier, an inner circumference of the circular plate, and a second inner circumference portion of the guide ring between the circular plate and the lower portion of the wafer carrier, the circular plate holding the wafer to be polished in the cavity.

13 Claims, 4 Drawing Sheets

APPARATUS FOR POLISHING A WAFER

FIELD OF INVENTION

The invention generally relates to a polishing apparatus for use in a semiconductor fabrication process and, more particularly, to an apparatus for polishing and uniformly reducing the thickness of a thin film or coating that has been applied to a semiconductor wafer.

BACKGROUND OF INVENTION

Semiconductor fabrication commonly requires polishing of a wafer. Machines for preparing and fabricating semiconductor wafers are known in the art. Wafer preparation includes slicing semiconductor crystals into thin sheets, and polishing the sliced wafers to free them of surface irregularities to achieve a planar surface. Typically, it is necessary for the formation of various circuits or for other uses of wafers, that the active or front face, e.g., the face of the wafer on which the integrated circuitry is to be formed, be highly polished.

In general, the polishing is accomplished in at least two steps. The first step is a rough polishing or abrasion. This step may be performed by an abrasive slurry lapping process in which a wafer mounted on a rotating carrier is brought into contact with a rotating polishing pad upon which is sprayed a slurry of insoluble abrasive particles suspended in a liquid. Material is removed from the wafer by the mechanical buffing action of the slurry. The second step is fine polishing. The fine polishing step is performed in a similar manner to the abrasion step, however, a slurry containing less abrasive particles is used. Alternatively, a polishing pad made of a less abrasive material may be used. The fine polishing step often includes a chemical mechanical polishing ("CMP") process. CMP is a combination of mechanical and chemical abrasion, and may be performed with an acidic or basic slurry. Material is removed from the wafer due to both the mechanical buffing and the action of the acid or base. Such polishing is also important during the manufacturing of semiconductor devices in order to planarize various thin film layers formed on the surface of a semiconductor wafer. The thin film may, for example, be an interlayer insulating film formed between two metal layers, a metal layer, or an organic layer.

Usually, polishing apparatuses bring the face of the wafer to be polished into engagement with a treating surface, such as the polishing surface of a rotating polishing pad having a desired polishing material, e.g., a slurry of colloida silica, applied thereto. In many instances, the polishing head which holds the wafer with the face exposed also rotates. It is the movement between the wafer and the polishing pad which results in the desired polishing. In some instances, polishing is provided primarily to make one face flat, or parallel to another face.

A polishing apparatus is shown in FIG. 1. A wafer 10 is held in a wafer carrier 20 by a guide ring 30. Optionally, a backing film 40 can be inserted between the wafer 10 and the carrier 20. The backing film 40 in combination with the guide ring 30 minimizes vertical movement of the wafer 10 during polishing. Without the backing film 40, the wafer 10 can freely move in the vertical direction during polishing. A backing film 40 or insert pad has been used in the wafer carrier 20 to keep the wafer 10 in contact with the surface of the polishing pad 50 to improve polished wafer surface uniformity.

The polishing pad 50 is affixed to a polishing table 60. In FIG. 1, the polishing table 60 is rotatable about its central axis 65. Wafer carrier 20 is also rotatable about its central axis 25, which except for a limited oscillating motion relative to the polishing table 60, is fixed relative to the central axis 65 of the polishing table 60. In operation, the polishing table 60 rotates at a first predetermined speed about its central axis 65, thereby presenting a continuously advancing polishing surface, i.e., polishing pad 50, to the layer being planarized. While wafer carrier 20 rotates at a second predetermined speed about its central axis 25, the wafer 10 is polished along an annular polishing area of the polishing table 60.

The polishing process is conducted by placing the wafer 10 within the cavity formed in the wafer carrier 20 by the backing film 40 and guide ring 30 so that wafer 10 contacts the polishing pad 50. During polishing, polishing pad 50 is supplied with an aqueous slurry 70 via supply nozzle 80, while the polishing table 60 rotates about its central axis 65. The materials of the polishing table 60, wafer carrier 20 and slurry 70 should be non-contaminating and, except for polishing action, non-destructive to the wafer 10 being polished.

At the inner portion of the wafer 10, apart from the edge of the wafer 10, the surface being polished is in continuous contact with the polishing pad 50. Therefore, the pressure applied by the polishing pad 50 across the inner portion of the wafer 10 is nearly constant. In contrast, the edge of wafer 10 constitutes a border between the area where the wafer 10 is in contact with the polishing pad 50 and the area where it is not in contact. Thus, at the outer portion of the wafer 10 including the edge, there is an irregularity of pressure applied during polishing. This results in nonuniform removal of the material from the wafer. Consequently, a portion of the surface of the wafer 10 may become overpolished or underpolished. When a backing film 40 is not used with the wafer carrier 20, the irregularity in the polished surface is relatively small since the wafer 10 can move freely during polishing. However, when a backing film 40 is used as shown in FIG. 1, the wafer 10 is fixed and the irregularity in the polished surface is more substantial. Thus, a backing film enhances surface uniformity at least with respect to all portions of the wafer, but for the edge. Uniformity between the edge and inner portion of a wafer is better served by not using a backing film.

Overpolishing causes the material being polished to become thinner which can adversely affect the performance and reliability of the semiconductor devices on the wafer. If a portion of the wafer is underpolished, the underpolished layer of material will likely be insufficiently planarized or remain too thick. Thus, subsequent electrical contact processing may not completely provide sufficient contact or sufficient insulation resulting in the formation of undesirable electrical open circuits or undesirable short circuit paths.

SUMMARY OF THE INVENTION

The present invention improves the polishing of a wafer so that the entire wafer is uniformly planarized. An improved carrier design is provided for improving polishing at the wafer edge, thereby achieving more uniformity across the surface of the polished wafer. Consequently, the potential for undesirable conditions resulting from both overpolishing and underpolishing is reduced.

An improved apparatus for polishing a wafer according to an illustrative embodiment of the present invention includes a wafer carrier, a guide ring coupled to a lower portion of the wafer carrier, a circular plate coupled to a first inner circumference portion of the guide ring distant from the wafer carrier, and a cavity, formed within an area bounded by the lower portion of the wafer carrier, an inner circumference of the circular plate, and a second inner circumference portion of the guide ring between the circular plate and the lower portion of the wafer carrier, the circular plate holding the wafer to be polished in the cavity.

An apparatus for polishing a wafer according to another illustrative embodiment of the present invention includes a wafer carrier, a pressure absorbing member coupled to the wafer carrier, a guide ring positioned adjacent to the lower portion of the wafer carrier, the guide ring coupled to the wafer carrier through the pressure absorbing member, and a cavity, formed within an area bounded by an inner circumference portion of the guide ring below the lower portion of the wafer carrier, the guide ring for holding the wafer to be polished in the cavity.

BRIEF DESCRIPTION OF THE DRAWINGS

The present invention will now be described in more detail with reference to preferred embodiments of the invention, given only by way of example, and illustrated in the accompanying drawings in which.

DETAILED DESCRIPTION

The present invention is discussed below with reference to a polishing process used in standard semiconductor wafer fabrication. However, the present invention may be applied to any polishing process for which the goal is to achieve a uniform polished surface.

The various embodiments of the present invention provide an apparatus which avoids the irregular application of pressure from the polishing pad across the wafer.

Figure 1:
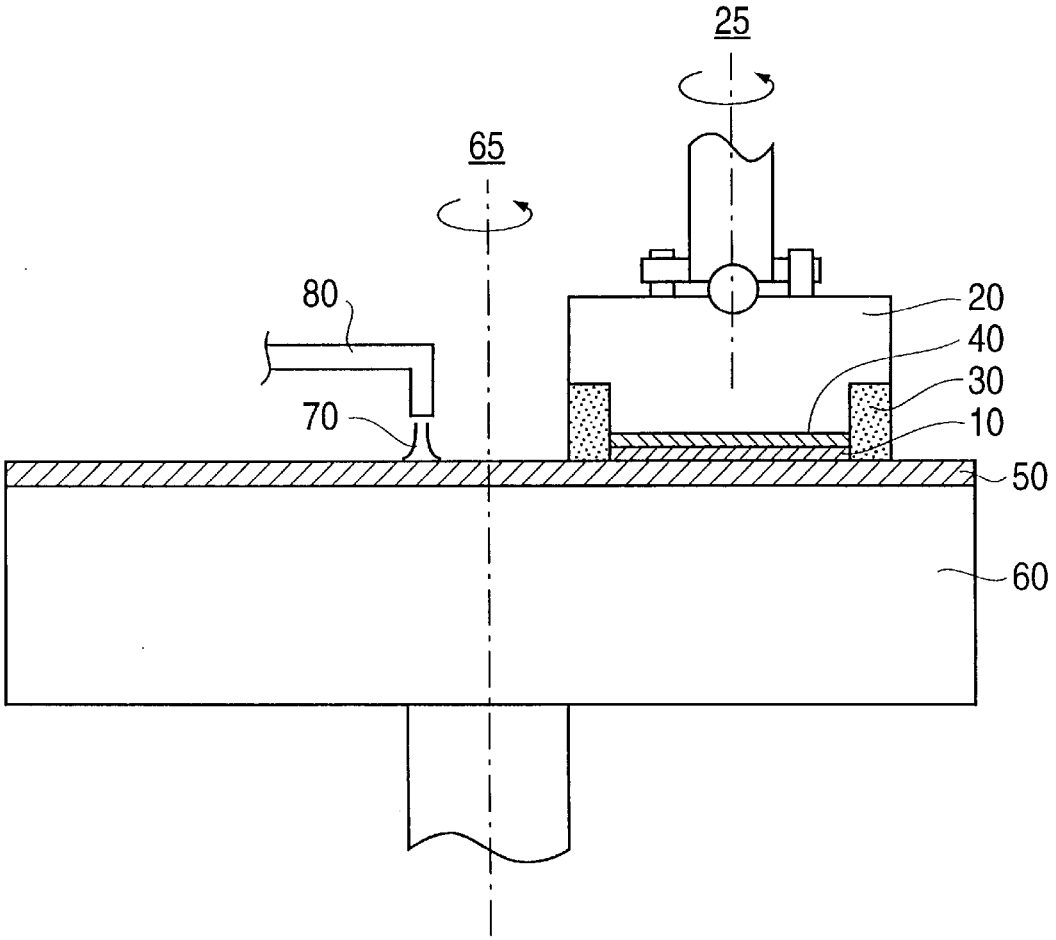
FIG. 1 (PRIOR ART)
FIG. 1 shows a conventional polishing apparatus.
Figure 2:
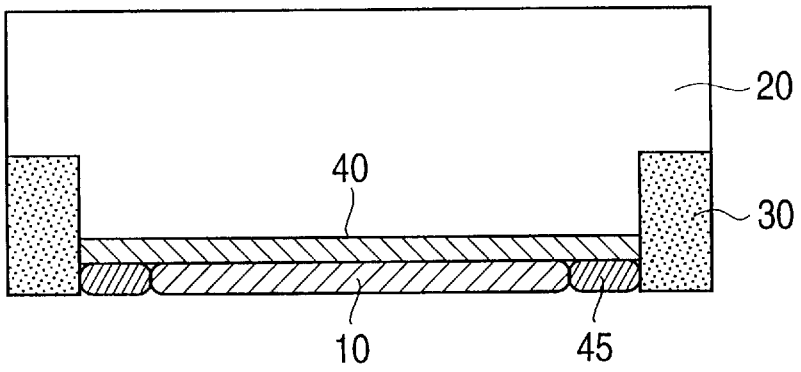
FIG. 2 shows an exemplary polishing apparatus according to a first embodiment of the present invention.

The same reference numerals are used for similar elements in the figures. FIG. 2 shows an exemplary CMP carrier tool design of a polishing apparatus according to the present invention.

In FIG. 2, a circular plate 45 is coupled to the guide ring 30. A cavity region is defined by the backing film 40 and the circular plate 45. It is to be understood that the backing film 40 is not a necessary element for any of the embodiments of the present invention. However, by employing a backing film with the present invention, typically, overall wafer uniformity is better served. If the backing film 40 is not used, a space remains in which the wafer 10 can freely move during polishing. The wafer 10, when inserted into the cavity region of the apparatus, is bounded by the inner circumference of the circular plate 45.

The thickness of the circular plate 45 is slightly less than the thickness of the wafer 10, and is made of a material having a greater hardness than the wafer 10. Thus, the edge of the wafer 10 is more uniformly polished with respect to the other portions of the wafer 10 because the circular plate 45 material will not polish as readily as the wafer 10. Consequently, more pressure will be applied to the polishing pad at the edge of the wafer 10, and the pressure applied across the entire wafer 10 will be more evenly distributed than with the prior art. The circular plate 45 may be made of materials including, but not limited to, amorphous carbon and polycarbonate. Further, the circular plate material may not be a material which pollutes or otherwise adversely affects the polishing process.

Figure 3:
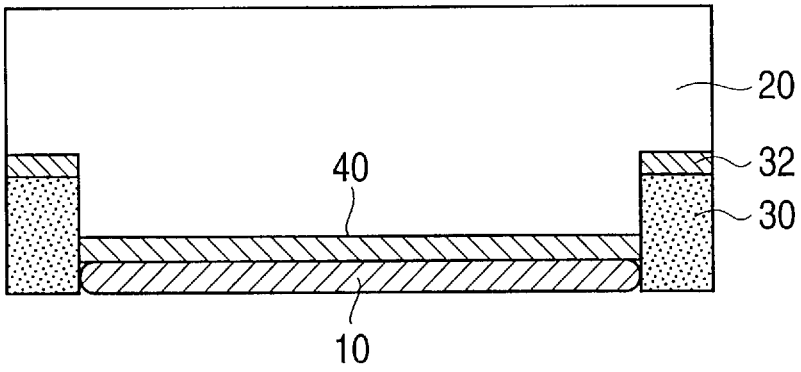
FIG. 3 shows an exemplary polishing apparatus according to a second embodiment of the present invention.
Figure 4:
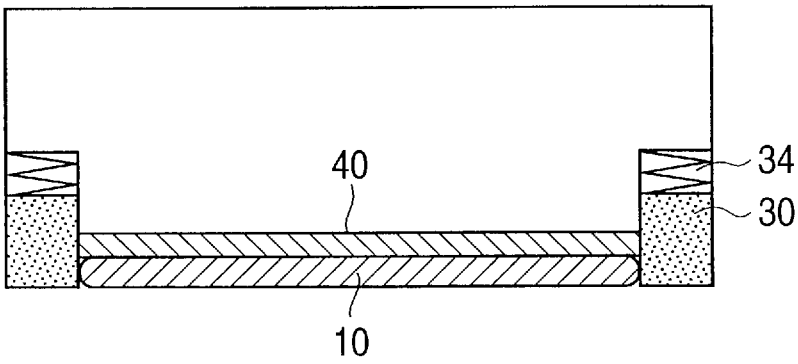
FIG. 4 shows an exemplary polishing apparatus according to a third embodiment of the present invention.
Figure 5:
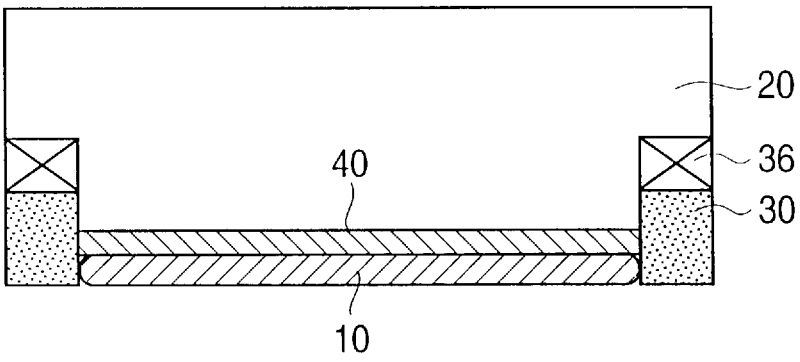
FIG. 5 shows an exemplary polishing apparatus according to a fourth embodiment of the present invention.

FIGS. 3–5 each illustrate exemplary CMP carrier tool designs of a polishing apparatus according to the present invention. Each of these embodiments has a pressure absorbing member which couples the guide ring 30 to the wafer carrier 20. The guide ring 30 positioned adjacent to the lower portion of the wafer carrier 20 holds the wafer 10 under the carrier 20. A cavity region for each of the FIG. 3–5 embodiments is defined by the inner circumference portion of the guide ring 30 below the lower portion of the wafer carrier 20 and the backing film 40.

According to the FIG. 3 embodiment, an elastic material 32 couples the guide ring 30 to the wafer carrier 20. A spring 34 couples the guide ring 30 to the wafer carrier 20 in the FIG. 4 embodiment. The wafer carrier 20 is coupled to the guide ring by an air cushion 36 in the FIG. 5 embodiment. It is to be understood that the embodiments of FIGS. 3–5 show illustrative pressure absorbing members, and that all pressure absorbing members equivalent to those shown or otherwise known in the art are considered within the scope of the invention.

When utilizing a pressure absorbing member as illustrated in the FIGS. 3–5 embodiments of the present invention, the applied polishing pressure can be more evenly distributed across the wafer 10.

Figure 6:
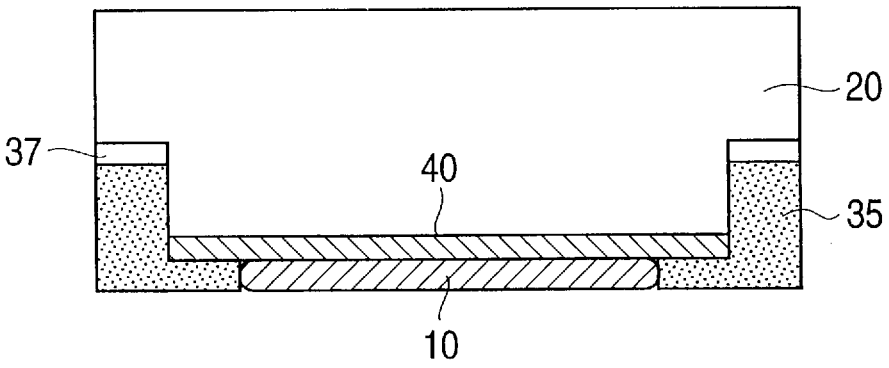
FIG. 6 shows an exemplary polishing apparatus according to a fifth embodiment of the present invention.

According to the FIG. 6 embodiment, a guide ring 35 having an L-shaped cross section is employed. The guide ring 35 includes a first portion coupled to a lower portion of the wafer carrier 20 and a second portion distant from the wafer carrier 20. There is a space 37 between the top of the guide ring 35 and the wafer carrier 20. The space 37 permits the L-shaped guide ring 3 to move vertically. While polishing a wafer, the wafer carrier 20 is forced downward thereby compressing the backing film 40. Depending on the compression of the backing film 40, it is necessary for the guide ring 35 to move vertically. The second portion is an L-shaped flange portion which acts similarly to the circular plate 45 shown in the FIG. 2 embodiment and described with reference thereto. The second portion of the guide ring 35 holds the wafer 10 in the cavity region. The cavity region is formed within an area bounded by the lower portion of the wafer carrier 20, an inner circumference of the second portion of the guide ring 35, and an inner circumference of the first portion of the guide ring 35 between the second portion of the guide ring 35 and the lower portion of the wafer carrier 20. Preferably, the characteristics (e.g., hardness, thickness, composition) of the second portion of the guide ring 35 are substantially the same as the characteristics of the circular plate described with respect to FIG. 2.

Figure 7:
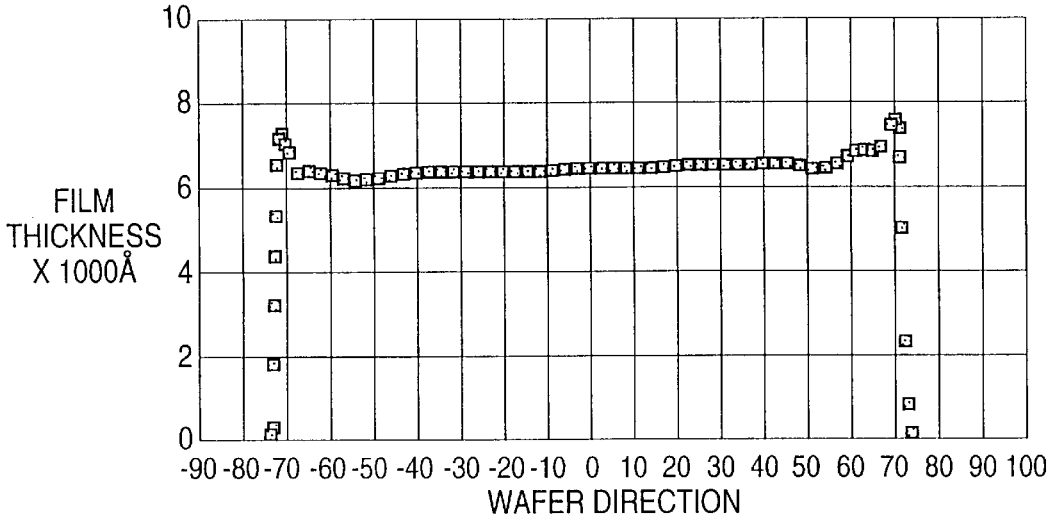
FIG. 7 shows the results of polishing when the present invention is not applied.
Figure 8:
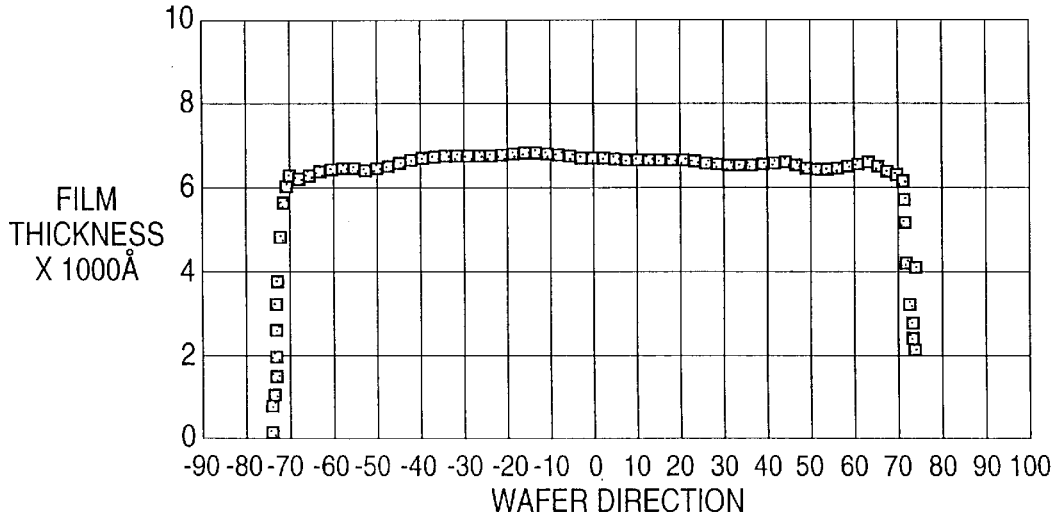
FIG. 8 shows the results of polishing when the first embodiment of the present invention is applied.

By applying the present invention, polishing is performed as if the diameter of the wafer 10 is larger than the actual diameter. Thus, the edge of the wafer 10 is polished as if it were in a central portion of the wafer 10, where the applied pressure is uniform. Thus, the present invention can compensate for irregularities in pressure across the wafer 10. The improved uniformity realized by the present invention can be seen by examining the graphs in FIGS. 7 and 8. FIG. 7 shows the thickness across the wafer following polishing when the present invention is not applied. FIG. 8 shows the improved uniformity across the wafer following polishing when the FIG. 2 embodiment is utilized. By comparing FIGS. 7 and 8, a marked improvement is shown for uniformity across the entire wafer, and in particular with respect to the edges and the central portion of the wafer.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. An apparatus for polishing a wafer comprising:

a wafer carrier;

a guide ring comprising a carrier plate having an L-shaped cross section, said guide ring including a first portion coupled to a lower portion of said wafer carrier and a second portion distant from said wafer carrier; and a cavity, formed within an area bounded by the lower portion of said wafer carrier, an inner circumference of the second portion of said guide ring, and an inner circumference of the first portion of said guide ring between the second portion of said guide ring and the lower portion of said wafer carrier, the second portion of said guide ring for holding a wafer to be polished in said cavity during polishing.

2. The apparatus according to claim 1, further comprising a backing film located below the lower portion of said wafer carrier bounding said cavity and in a region bounded by the inner circumference of said guide ring between the second portion of said guide ring and the lower portion of said wafer carrier.

3. An apparatus according to claim 1, wherein said inner circumference of said guide ring is in contact with an outer circumference of said wafer.

4. An apparatus according to claim 1, wherein said inner circumference of said guide ring and the outer circumference of said wafer have no gap therebetween.

5. An apparatus for polishing a wafer, comprising:

a wafer carrier;

a guide ring coupled to a lower portion of said wafer carrier;

a circular plate, coupled to an inner circumference portion of said guide ring distant from said wafer carrier, for holding a wafer during polishing; and a backing film separating said wafer carrier from the wafer and the entire upper surface of said circular plate during polishing.

6. The apparatus according to claim 5, wherein said circular plate is for use with a wafer having a thickness which is slightly greater than said circular plate.

7. The apparatus according to claim 5, wherein said circular plate is made of a material for use with a wafer having a hardness less than the hardness of the material.

8. The apparatus according to claim 7, wherein the material is an amorphous carbon or polycarbonate.

9. An apparatus according to claim 5, wherein said inner circumference of said circular plate is in contact with an outer circumference of said wafer.

10. An apparatus according to claim 5, wherein said inner circumference of said circular plate and the outer circumference of said wafer have no gap therebetween.

11. An apparatus for polishing a wafer comprising:

a wafer carrier;

a guide ring disposed below said wafer carrier;

a cavity, formed within an area bounded by an inner circumference portion of said guide ring below a lower portion of said wafer carrier, said guide ring for holding a wafer to be polished in said cavity during polishing; and an air cushion disposed between said guide ring and said wafer carrier for cushioning said guide ring;

wherein said guide ring evenly distributes polishing pressure applied to the wafer.

12. An apparatus according to claim 11, wherein said inner circumference of said guide ring is in contact with an outer circumference of said wafer.

13. An apparatus according to claim 11, wherein said inner circumference of said guide ring and the outer circumference of said wafer have no gap therebetween.

* * * * *